United States Patent [19]

Labenz

[11] Patent Number: 4,554,772

[45] Date of Patent: Nov. 26, 1985

[54] BOOT GUARD FOR SEWER MANHOLE CONSTRUCTION

[76] Inventor: Gary F. Labenz, 11938 Big Lake Rd., Davisburg, Mich. 48019

[21] Appl. No.: 578,157

[22] Filed: Feb. 8, 1984

[51] Int. Cl.[4] ..... E04B 1/62

[52] U.S. Cl. ..... 52/396; 52/220; 285/192

[58] Field of Search ..... 52/396, 20, 21, 220, 52/230, 302, 223 L; 285/192

[56] References Cited

U.S. PATENT DOCUMENTS

| | | | |
|---|---|---|---|
| 3,421,551 | 1/1969 | Currier | 52/302 X |
| 3,673,644 | 7/1972 | Howlett et al. | 52/223 L X |
| 3,975,799 | 8/1976 | Kerr | 52/230 X |

FOREIGN PATENT DOCUMENTS

| | | | |
|---|---|---|---|
| 380347 | 9/1964 | Switzerland | 52/223 L |

*Primary Examiner*—Carl D. Friedman

*Assistant Examiner*—Naoko N. Slack

*Attorney, Agent, or Firm*—Cullen, Sloman, Cantor, Grauer Scott & Rutherford

[57] ABSTRACT

A boot guard which is fitted onto the end of a sewer pipe for abutting engagement with the flexible seal between the sewer pipe and manhole side wall opening for protecting the flexibility of the joint seal and permitting easier removal of the sewer pipe for repair or replacement. The boot guard includes a generally half-circle, annular base portion having an undercut rectangular peripheral groove therein. A flexible securing band is fitted into the undercut groove and wrapped around the upper periphery of the sewer pipe for holding the base portion in place prior to concrete being poured into the bottom of the manhole construction. When concrete is poured into the bottom of the manhole construction, the boot guard prevents contact between the concrete and the flexible seal and also prevents contact between the concrete and the end of the sewer conduit.

1 Claim, 5 Drawing Figures

BOOT GUARD FOR SEWER MANHOLE CONSTRUCTION

BACKGROUND OF THE INVENTION

The present invention relates to a boot guard for preventing contact between the concrete poured into the bottom of a manhole construction and the flexible joint connection between a sewer conduit and manhole wall opening.

Sewer manhole constructions have been used for many years for providing ample space to clean or open clogged sewers. They are usually placed at intervals of 300–500 feet with a straight line portion of the sewer extending between a pair of adjacent manholes. Usually, the manhole enlarges to about four feet in diameter and continues at this diameter down to the sewer elevation. The sewage is carried through the manhole floor in channels in the floor with the depth of the channels being up to the full diameter of the sewer conduit ends which extend into the manhole.

A quantity of concrete is normally poured into the bottom of the manhole construction up to and adjacent the side wall openings which receive the sewer conduits to provide a flooring for the bottom section of the manhole. Conventionally, one or more U-shaped channels are formed in the top surface of the flooring which communicate with respective inlet and outlet ends of the sewer conduits so that sewage from the sewer conduits flows in the channels in the bottom of the flooring through the manhole construction and outwardly thereof.

Thus, after a manhole construction is placed within the ground with the sewer conduits connected thereto, it is conventional to pour concrete into it and form channels between the open ends of the sewer conduits for permitting the sewage to be carried through the manhole. Since it is important that the flexible joint or seal between the sewer conduit and manhole wall opening remain flexible, something must be done to prevent poured concrete from engaging the flexible joint connection between the sewer conduit and manhole wall opening. Further, it is not desirable that concrete be poured against the end of the sewer conduit or against the flexible joint connection because removal of the sewer conduit for repair or replacement is made much more difficult.

Heretofore, when the concrete was poured into the bottom of the manhole construction, a gap was formed between the concrete that was poured into the bottom of the manhole and the ends of the sewer conduits extending into the manhole. This procedure for preventing contact between the poured concrete and flexible joint for protecting the flexibilty of the pipe joint and permitting removal involves considerable time and effort and, therefore, is expensive.

Thus, there has been a need for an inexpensive means for preventing contact between the poured concrete and flexible joint connection between a sewer conduit and manhole wall opening.

SUMMARY OF THE INVENTION

The present invention is used in connection with a manhole construction having a generally cylindrical bottom section includng a side wall and bottom wall. The generally cylindrical bottom section is adapted for placement within the ground in a known fashion at a pre-determined depth for receiving the ends of sewer conduits. A portion of each sewer conduit extends loosely into the through an opening in the side wall of the manhole. The outer periphery of the pipe is sealed with respect to the wall opening by means of a flexible seal.

As described, after the manhole construction is placed within the ground with the sewer conduits connected thereto, concrete is poured into the bottom section of the manhole and channels are formed between the open ends of the sewer conduits for permitting the sewage to be carried through the manhole. Since it is important that the joint or seal between the sewer conduit and manhole wall opening remain flexible, something must be done to prevent poured concrete from engaging the flexible joint connection between the sewer conduit and manhole wall opening. Further, it is not desirable that concrete be poured against the end of the sewer conduit or against the flexible joint cnnection because removal of the sewer conduit for repair or replacement would be made much more difficult.

The present invention solves these problems by providing a plastic or rubber boot guard which is fitted onto the end of the sewer pipe for abutting engagement with the flexible seal. The boot guard includes a generally half-circle, annular base portion having an undercut rectangular peripheral groove therein. A flexible securing band is fitted into the undercut groove and wrapped around the upper periphery of the sewer pipe for holding the base portion in place prior to concrete being poured into the bottom of the manhole consturction.

The boot guard is installed onto the end of the sewer conduit in abutting engagement with the flexible seal prior to the pouring of the concrete into the bottom of the manhole construction. Concrete is then poured into the manhole but the boot guard prevents contact between the concrete and flexible seal and also prevents contact between the concrete and the end of the sewer conduit. Thus, the boot guard protects the flexiblity of the flexible joint and permits easy removal of the sewer conduit for repair or replacement.

After the concrete is poured into the manhole and before it has set, the boot guard may be easily removed from the end of the sewer conduit by releasing the flexible securing band thereby leaving a void or gap between the concrete, sewer conduit, and flexible seal. Further, the boot guard can act as a guide in the forming of the U-shaped channels along the floor of the manhole.

Other advantages and meritorious features of the boot guard of the present inventon will be more fully understood from the following description of the inventon, the appended claims, and the drawings, a brief description of which follows.

DETAILED DESCRIPTION OF THE INVENTION

Figure 1:
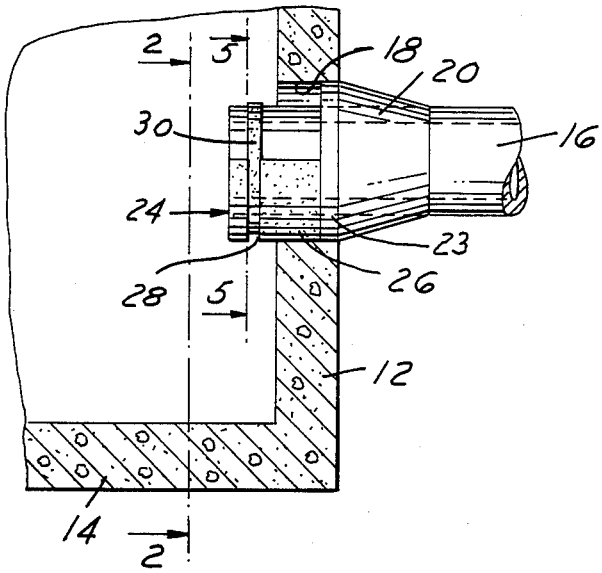
FIG. 1 is a side elevational view of the boot guard installed onto the end of a sewer conduit and in abutting engagement against the flexible joint connection between the sewer conduit and manhole side wall opening.
Figure 2:
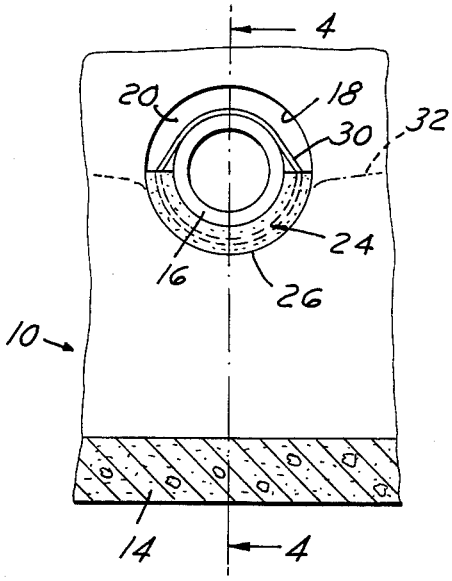
FIG. 2 is a front view taken along line 2—2 in FIG. 1 and illustrating in phantom the concrete poured into the bottom of the manhole construction.
Figure 3:
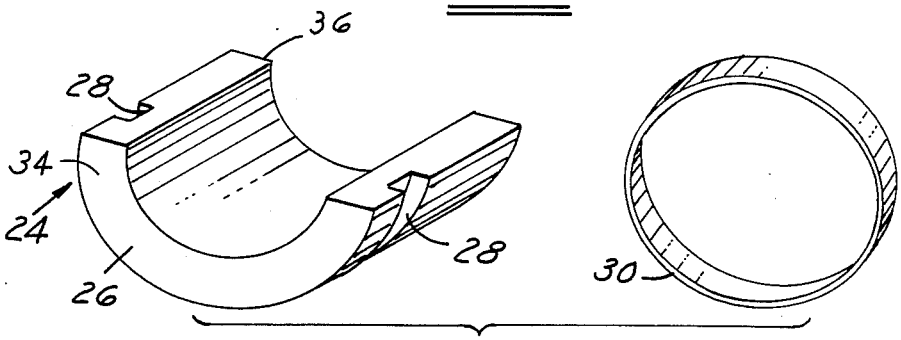
FIG. 3 is a perspective view of the boot guard assembly.
Figure 4:
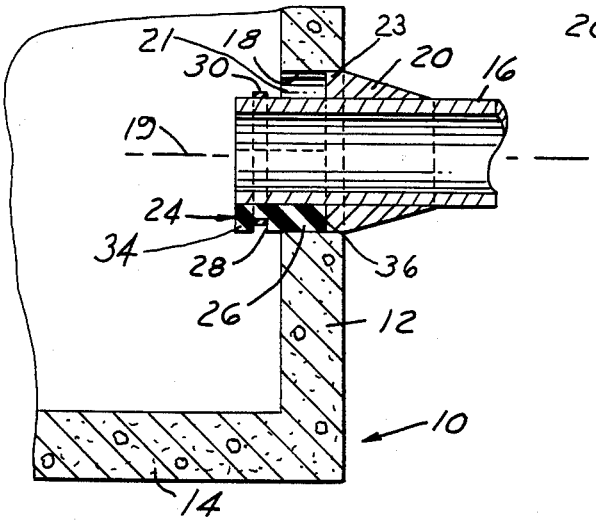
FIG. 4 is a cross-sectional view taken along line 4—4 in FIG. 2.
Figure 5:
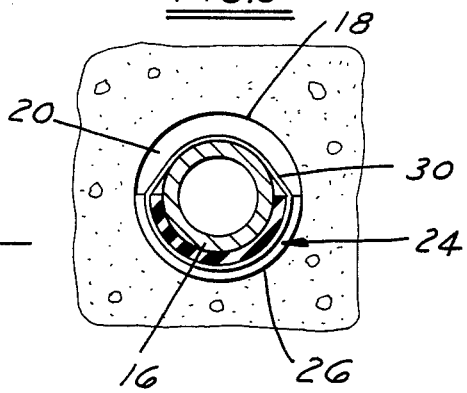
FIG. 5 is a cross-sectional view taken along line 5—5 in FIG. 1.

FIGS. 1–5 illustrate a preferred embodiment of the boot guard of the present invention. Referring to FIGS. 1, 2 and 4, a bottom cylindrical section of a conventional sewer manhole construction 10 is generally illustrated including a vertically extending side wall 12 and a horizontal bottom wall 14. The cylindrical bottom section 10 is adapted for placement within the ground in a known fashion at a pre-determined depth for receiving the ends of sewer conduits. While only one sewer conduit or pipe 16 is illustrated, it will be understood that the present invention is used in connection with each of the sewer conduits that extend into the bottom cylindrical section of manhole construction 10.

A portion of a sewer conduit or pipe 16 is a fragmentarily shown as extending loosely into and through an opening 18 in the vertical side wall 12. The opening 18 and pipe 16 have generally the same horizontally extending axis 19. The outer periphery of pipe 16 is sealed with respect to wall opening 18 by means of a flexible seal 20 which is generally shaped as a truncated cone. As is conventional, at least one or more additional sewer conduits would be connected to manhole construction 10 to permit the ingress and egress of sewage. With such a construction the end of pipe 16 within opening 18 is spaced from the wall surface defining the opening 18. The space is referred to herein as an annular recess 21. The flexible seal 20 includes an annular rim or rim portion 23 which extends into and is received by the annular recess 21 adjacent the end of the sewer pipe where the pipe enters the opening 20 to form the seal in the vertical side wall 12.

After a manhole construction is placed within the ground with the sewer conduits such as 16 connected thereto, it is common to pour concrete into it and form channels between the open ends of the sewer conduits for permitting the sewage to be carried through the manhole. Since it is important that the joint or seal 20 between the sewer conduit and manhole wall opening 18 remain flexible, something must be done to prevent poured concrete from engaging the flexible joint connection between the sewer conduit and manhole wall opening. Further, it is not desirable that concrete be poured against the end of the sewer conduit 16 or against the flexible joint connection 20 because removal of the sewer conduit for repair or replacement is made much more difficult.

Heretofore, when the concrete was poured into the bottom of the manhole construction, a gap was formed between the concrete that was poured into the bottom of the manhole and the ends of the sewer conduits extending into the manhole. This procedure for preventing contact between the poured concrete and flexible joint involves considerable time and effort and, therefore, is expensive. Thus, the present invention relates to an inexpensive means of preventing contact between the poured concrete and flexible joint connection between the sewer conduit and manhole wall opening.

In particular, the present invention is directed to a plastic or rubber boot guard 24 which is fitted onto the end of sewer pipe 16 for abutting engagement with flexible seal 20. Boot guard 24 includes a generally halfcircle, annular base portion 26 having an undercut, rectangular peripheral groove 28 therein. A flexible securing band 30 is fitted into undercut groove 28 and wrapped around the upper periphery of pipe 16, as shown, for holding base portion 26 in place prior to concrete being poured into the bottom of manhole construction 10.

The plastic boot guard 24 is installed onto the end of the sewer conduit 16 in abutting engagement with flexible seal 20 prior to the pouring of concrete into the bottom of manhole construction 10. As shown by the phantom line 32 in FIG. 2, concrete is then poured into the manhole but boot guard 24 prevents contact between the concrete and flexible seal 20 and also prevents contact between the concrete and the end of sewer conduit 16. Thus, boot guard 24 protects the flexibility of seal 20 and permits easier removal of sewer conduit 16 for repair or replacement.

After the concrete is poured into the manhole and before it has set, boot guard 24 may be easily removed from the end of sewer conduit 16 by releasing flexible securing band 30 thereby leaving a void or gap between the concrete, sewer conduit 16, and flexible seal 20. Further, boot guard 24 can act as a guide in the forming of the U-shaped channels, previously described, along the floor of the manhole.

It will be apparent to those skilled in the art that the foregoing disclosure is exemplary in nature, rather than limiting, the invention being limited only by the appended claims.

I claim:

1. In a sewer manhole construction including a cylindrical bottom section adapted for placement within the ground at a predetermined depth, said bottom section having a vertically extending side wall and a horizontal bottom wall, an opening having a horizontal axis extending through the side wall and being vertically spaced from said bottom wall, and at least one sewer pipe having an end extending into and through said opening in said vertical side wall, said end of the sewer pipe having the same horizontal axis as said opening and being spaced from the wall surface defining the opening by an annular recess, a flexible annular seal surrounding the sewer pipe and including an annular rim portion which extends into said annular recess adjacent where the end of the sewer pipe enters the opening in the side wall and seals said opening, the improvement comprising a boot guard fitted onto said end of the sewer pipe, said boot guard including a generally half-circle, annular base portion having an undercut peripheral groove therein and a pair of first and second end surfaces, said groove being located near said first end surface, said base portion extending into said annular recess with said second end surface abutting said flexible seal, said guard including a flexible securing band located in said undercut groove and wrapped around the upper periphery of said end of the sewer pipe for holding said base portion in place ins aid side wall prior to concrete being poured into the bottom section of said manhole construction, said boot guard when concrete is poured into said bottom section preventing contact between the concrete and said flexible seal and also preventing contact between the concrete and said end of the sewer pipe for maintaining the flexibility of said flexible seal and permitting easier removal of said sewer pipe for repair or replacement.

* * * * *